US009425012B2

(12) United States Patent
Takeuchi

(10) Patent No.: US 9,425,012 B2
(45) Date of Patent: Aug. 23, 2016

(54) ELECTROMAGNETIC OPERATION DEVICE FOR VACUUM CIRCUIT BREAKER

(75) Inventor: Yasushi Takeuchi, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 262 days.

(21) Appl. No.: 14/241,604

(22) PCT Filed: Dec. 12, 2011

(86) PCT No.: PCT/JP2011/078646

§ 371 (c)(1), (2), (4) Date: Feb. 27, 2014

(87) PCT Pub. No.: WO2013/031037

PCT Pub. Date: Mar. 7, 2013

(65) Prior Publication Data

US 2014/0226250 A1 Aug. 14, 2014

(30) Foreign Application Priority Data

Aug. 29, 2011 (JP) ..... 2011-185603

(51) Int. Cl.

| | |
|---|---|
| ***H01H 47/26*** | (2006.01) |
| ***H01H 47/32*** | (2006.01) |
| ***H01H 33/59*** | (2006.01) |
| ***H01H 33/666*** | (2006.01) |
| *H01H 11/00* | (2006.01) |

(52) U.S. Cl.

CPC ..... *H01H 47/26* (2013.01); *H01H 33/59* (2013.01); *H01H 33/6662* (2013.01); *H01H 2011/0068* (2013.01)

(58) Field of Classification Search

CPC ... H01H 47/26; H01H 33/59; H01H 33/6662; H01H 33/56

USPC ..... 361/161, 165

See application file for complete search history.

(56) References Cited

U.S. PATENT DOCUMENTS 5,790,355 A * 8/1998 Ishmael ..... H02J 7/0031 318/430

6,286,377 B1 * 9/2001 Benke ..... H01H 11/0062 73/865.9

(Continued)

FOREIGN PATENT DOCUMENTS

CN 1327607 A 12/2001

CN 1950711 A 4/2007

(Continued)

OTHER PUBLICATIONS

Office Action (First Office Action) issued on Jun. 3, 2015, by the Chinese Patent Office in corresponding Chinese Patent Application No. 201180073196.1, with an English translation of the Office Action. (17 pages).

(Continued)

*Primary Examiner* — Dharti Patel

(74) *Attorney, Agent, or Firm* — Buchanan Ingersoll & Rooney PC

(57) ABSTRACT

There is provided an electromagnetic operation device for a vacuum circuit breaker, which controls by its electromagnetic operation, a speed of contact switching operation of a vacuum switch tube used in the vacuum circuit breaker, the electromagnetic operation device including a closing drive coil for the vacuum switch tube; and a first temperature sensor that measures a temperature surrounding the closing drive coil, wherein a current caused to flow through the closing drive coil is controlled based on the temperature measured by the first temperature sensor.

18 Claims, 5 Drawing Sheets

(56) References Cited

U.S. PATENT DOCUMENTS

| | | | | |
|---|---|---|---|---|
| 6,574,084 | B1 | 6/2003 | Kishida et al. | |
| 6,982,750 | B1 | 1/2006 | Yoshida et al. | |
| 7,936,549 | B2 * | 5/2011 | Takeuchi | G01R 31/043 335/213 |
| 2007/0222427 | A1 | 9/2007 | Takeuchi et al. | |
| 2012/0187089 | A1 * | 7/2012 | Chen | H01H 33/14 218/2 |

FOREIGN PATENT DOCUMENTS

| | | | |
|---|---|---|---|
| JP | 2001-57135 | A | 2/2001 |
| JP | 2001-127934 | A | 5/2001 |
| JP | 2003-307771 | A | 10/2003 |
| JP | 2007-202298 | A | 8/2007 |
| JP | 2009-176527 | A | 8/2009 |
| JP | 2010-272296 | A | 12/2010 |
| WO | WO 01/31667 | A1 | 5/2001 |
| WO | 2005/111641 | A1 | 11/2005 |
| WO | WO 2005/111641 | A1 | 11/2005 |

OTHER PUBLICATIONS

International Search Report (PCT/ISA/210) mailed on Mar. 13, 2012, by the Japan Patent Office as the International Searching Authority for International Application No. PCT/JP2011/078646.

* cited by examiner

ELECTROMAGNETIC OPERATION DEVICE FOR VACUUM CIRCUIT BREAKER

TECHNICAL FIELD

This invention relates to "an electromagnetic operation device for a vacuum circuit breaker" that controls a contact-switching operation of a vacuum switch tube used in the vacuum circuit breaker, by means of a driving force using electromagnetic force, and in more particular, relates to an electromagnetic operation device for a vacuum circuit breaker that can suppress change in speed of the contact switching operation, even if a temperature change occurs in a drive coil and/or a drive capacitor constituting the electromagnetic operation device.

BACKGROUND ART

FIG. 6 is a diagram showing an electromagnetic operation device for a power switching apparatus (vacuum circuit breaker) disclosed for example in Japanese Domestic Re-Publication No. WO2005/111641 (Patent Document 1).

Using FIG. 6, a configuration of the conventional electromagnetic operation device for a vacuum circuit breaker will be described.

A vacuum switch tube (called also as a vacuum valve) 50 constituting the vacuum circuit breaker has a switching contact 51 accommodated in a vacuum vessel. The switching contact 51 is composed of a fixed contact 51*a* and a movable contact 51*b*, and in the contact open state, the fixed contact 51*a* and the movable contact 51*b* are placed opposite to each other with a given space therebetween.

To the movable contact 51*b*, a driving shaft 52 is fixed, so that the movable contact 51*b* and the driving shaft 52 constitute a movable section. The movable section is coupled to a movable core 61 in an electromagnetic operation mechanism 60 through a contact pressure spring and a spring seat 54.

The electromagnetic operation mechanism 60 has a movable core 61, a closing drive coil 62 and an opening drive coil 63.

The closing drive coil 62 serves to drive the movable contact 51*b* to thereby achieve the contact closed state, and the opening drive coil 63 serves to drive the movable contact 51*b* to thereby achieve the contact open state.

The closing drive coil 62 and the opening drive coil as driving magnetic coils are arranged in axial direction of the movable core 61 with a given distance therebetween. The movable core 61 is disposed centrally in the closing drive coil 62 and the opening drive coil 63, and movably in its axial direction.

A driving power supply unit 70 has a closing drive capacitor 71, an opening drive capacitor 72, a close command switch 73 and an open command switch 74.

When the close command switch 73 is turned on, a voltage charged in the closing drive capacitor 71 is applied to the closing drive coil 62, so that a current flows through the closing drive coil 62 to thereby cause a drive toward the contact closed state. Meanwhile, when the open command switch 74 is turned on, a voltage charged in the opening drive capacitor 72 is applied to the opening drive coil 63, so that a current flows through the opening drive coil 63 to thereby cause a drive toward the contact open state.

Note that, in FIG. 6, shown at 81 is a connection line, at 82 is a current measuring device, and at 83 is a contact depletion amount measuring device; however, since they are not relevant to the present invention, their description is omitted here.

A status recognition device disclosed in the above Patent Document 1, is to be equipped in the electromagnetic operation device which comprises a fixed core, a movable core configured movably with respect to the fixed core, and a magnetic coil that causes to move the movable core being magnetically excited by a driving power supply, to thereby drive an operational target instrument (vacuum switch tube) being coupled to the movable core, wherein the status recognition device includes a measuring means for measuring a current flowing through the magnetic coil or a voltage generated in the magnetic coil, and an exploring means for acquiring information about a change in a waveform outputted from the measuring means, to thereby estimate a status of the operational target instrument or the electromagnetic operation device on the basis of the information about the change from the exploring means.

In Patent Document 1, however, there is no description as to "occurrence of change in speed of the contact switching operation, due to a change in current flowing through the magnetic coil" that is caused by a temperature change of the magnetic coil (the opening drive coil, the closing drive coil) or the capacitor (the opening drive capacitor, the closing drive capacitor) in the electromagnetic operation device for a vacuum circuit breaker using the vacuum switch tube, as well as to "suppression of change in speed of the contact switching operation".

Meanwhile, FIG. 7 is a diagram showing a configuration of an electromagnetic-repulsion drive switching device disclosed for example in Japanese Domestic Re-Publication No. W001/031667 (Patent Document 2).

The electromagnetic-repulsion drive switching device shown in FIG. 7 (that is, an electromagnetic operation device for a vacuum circuit breaker), is an electromagnetic-repulsion drive switching device which is configured to include a closing drive coil 101 and an opening drive coil 102 that are arranged opposite to an electrically-conductive repulsion member; and to make contact or separation between a fixed contact and a movable contact by way of an electromagnetic repulsion force produced between either one of the coils 101, 102 and the repulsion member, when a drive current is supplied selectively to either one of the coils 101, 102 from a capacitor 104 charged at a predetermined voltage by a charging power supply 103; wherein a voltage control means 105 is provided that controls an output voltage of the charging power supply 103 so that a peak value of the drive current falls in a predetermined range, against a temperature change of the capacitor 104.

In Patent Document 2, there is described that "the contact is operated stably and accurately by providing the voltage control means to thereby control a peak value of the drive current to fall in the predetermined range even if the temperature of the capacitor changes".

That is, in Patent Document 2, there is described that change in speed of the contact switching operation is suppressed by controlling the magnitude of current flowing through the closing drive coil or the opening drive coil according to a temperature change of the drive capacitor for causing a current to flow through the closing drive coil or the opening drive coil.

However, even in Patent Document 2, there is no description as to suppression of change in speed of the contact switching operation caused by a change in surrounding temperature of the magnetic coil (the opening drive coil, the closing drive coil) in an electromagnetic operation device for a vacuum circuit breaker using a vacuum switch tube.

Patent Document 1: Japanese Domestic Re-Publication No. WO2005/111641

Patent Document 2: Japanese Domestic Re-Publication No. WO01/031667

SUMMARY OF THE INVENTION

Problems to be Solved by the Invention

For vacuum circuit breakers, an operational duty (operation specification) is defined in the standard (JEC-2300), in which it is required to make close/open (that is, a closed/open state operation) for three cycles (50 msec).

It is noted that "JEC" represents "Japanese Electro-technical Committee".

In normal use conditions of the vacuum circuit breakers, in order to fulfill the operational duty, energizing the drive coil is controlled by a constant period of time.

However, because of variation in ambient temperature, the resistance value of the drive coil in the electromagnetic operation device changes, so that the current value flowing through the drive coil changes. This makes change in operation speed of the movable contact in the vacuum switch tube constituting the vacuum circuit breaker.

What is particularly problematic is that "when the surrounding ambient temperature becomes lower, the temperature of the closing drive coil also becomes lower, so that the resistance value of the drive coil becomes smaller thereby making larger the value of the current flowing through the closing drive coil."

When the value of the current flowing through the closing drive coil becomes larger, the movable contact is caused to move faster, so that contact touching (making contact between the movable contact and the fixed contact in the vacuum switch tube, that is, a closing operation) is achieved faster than that in the normal condition.

On the other hand, when the surrounding ambient temperature becomes higher, the temperature of the opening drive coil also becomes higher, so that the resistance value of the opening drive coil becomes larger thereby making smaller the value of the current flowing through the opening drive coil.

When the value of the current flowing through the opening drive coil becomes smaller, the movable contact is caused to move slower, so that the opening operation becomes slower than that in the normal condition.

In normal use conditions of the vacuum circuit breakers, energizing the closing drive coil and the opening drive coil is controlled by a constant period of time.

Thus, there is a problem that when the contact operation at the time of closing becomes faster than normal or the contact operation at the time of opening becomes slower than normal, the whole time to make close/open of the contact becomes longer, so that the operational duty of making close/open for three cycles (50 msec) could not be fulfilled.

Meanwhile, the charging capacity of each of the closing drive capacitor and the opening drive capacitor changes when its temperature becomes lower. For example, when the temperature becomes lower and thus the charging capacity becomes smaller, the charged energy becomes smaller, so that the current flowing through the closing drive coil and the opening drive coil becomes decreased to thereby affect the operation speed of the movable contact.

FIG. 8 is image diagrams for illustrating a problem at the time of closing operation of a conventional vacuum circuit breaker, in which shown at FIG. 8(*a*) is a diagram for illustrating a state of the contact under operation when the temperature of the closing drive coil becomes lower.

The solid line A shown in FIG. 8(*a*) is a transition line of a position of the contact when the temperature of the closing drive coil is a normal temperature, and the broken line B is a transition line of a position of the contact when the temperature of the closing drive coil becomes lower, so that the contact touching (closing operation) becomes faster.

As shown in FIG. 8(*a*), according to the conventional vacuum circuit breaker, when the temperature of the closing drive coil becomes lower and thus the contact touching becomes faster, the whole time to make close/open of the contact becomes longer, so that the operational duty of "making close/open for three cycles (50 msec)" can not be fulfilled.

Further, when there is a change in the temperature of the drive capacitor for applying its charged voltage to the closing drive coil so as to cause a current to flow therethrough, since the value of the current flowing through the closing drive coil changes, the speed for contact touching changes to thereby affect the whole time to make close/open of the contact. Thus, there is a risk that the operational duty of "making close/open for three cycles (50 msec)" can not be fulfilled.

It is noted that shown at FIG. 8(*b*) are a changing state of the current flowing through the closing coil (closing drive coil) and a changing state of the current flowing through the opening coil (opening drive coil).

Meanwhile, as described above, when the surrounding temperature becomes higher, the temperature of the opening drive coil also becomes higher, so that the resistance value of the opening drive coil becomes larger thereby making smaller the value of the current flowing through the drive coil.

When the value of current flowing through the opening drive coil becomes smaller, the movable contact is caused to move slower at the time of opening operation, so that the opening operation becomes slower than that of the normal condition.

In normal use conditions of the vacuum circuit breakers, energizing the opening drive coil is also controlled by a constant period of time.

Thus, there is also a problem that when the operation of the contact at the time of opening becomes slower than normal, the whole time to make close/open of the contact becomes longer, so that the operational duty of making close/open for three cycles (50 msec) can not be fulfilled.

FIG. 9 is image diagrams for illustrating a problem at the time of opening operation of the conventional vacuum circuit breaker, in which shown at FIG. 9(*a*) is a diagram for illustrating a state of the contact under operation when the temperature of the opening drive coil becomes lower.

The solid line A shown in FIG. 9(*a*) is a transition line of a position of the contact when the temperature of the opening drive coil is a normal temperature, and the broken line B is a transition line of a position of the contact when the temperature of the opening drive coil becomes higher, so that the opening operation becomes slower.

As shown in FIG. 9(*a*), according to the conventional vacuum circuit breaker, when the temperature of the opening drive coil becomes higher and thus the opening operation becomes slower, the whole time to make close/open of the contact becomes longer, so that the operational duty of "making close/open for three cycles (50 msec)" can not be fulfilled.

It is noted that shown at FIG. 9(*b*) are a changing state of the current flowing through the closing coil (closing drive coil) and a changing state of the current flowing through the opening coil (opening drive coil).

This invention has been made to solve such conventional problems, and an object thereof is to provide an electromagnetic operation device for a vacuum circuit breaker, which is capable of suppressing change in speed of the contact switching operation by accurately controlling the change in the current flowing through the closing drive coil and/or the opening drive coil, even if the temperature of either or both of the closing drive coil and the opening drive coil changes and even if the temperature of the closing drive capacitor or the opening drive capacitor changes, whereby the operational duty of making close/open for three cycles (50 msec) defined in the standard (JEC-2300) can be fulfilled,

Means for Solving the Problems

An electromagnetic operation device for a vacuum circuit breaker according to the invention is such an electromagnetic operation device for a vacuum circuit breaker, which controls by its electromagnetic operation, a speed of contact switching operation of a vacuum switch tube used in the vacuum circuit breaker, said electromagnetic operation device comprising a closing drive coil for the vacuum switch tube and a first temperature sensor that measures a temperature surrounding the closing drive coil, wherein a current caused to flow through the closing drive coil is controlled based on the temperature measured by the first temperature sensor.

Further, another electromagnetic operation device for a vacuum circuit breaker according to the invention is such an electromagnetic operation device for a vacuum circuit breaker, which controls by its electromagnetic operation, a speed of contact switching operation of a vacuum switch tube used in the vacuum circuit breaker, said electromagnetic operation device comprising an opening drive coil for the vacuum switch tube and a third temperature sensor that measures a temperature surrounding the opening drive coil, wherein a current caused to flow through the opening drive coil is controlled based on the temperature measured by the third temperature sensor.

Further, another electromagnetic operation device for a vacuum circuit breaker according to the invention is such an electromagnetic operation device for a vacuum circuit breaker, which controls by its electromagnetic operation, a speed of contact switching operation of a vacuum switch tube used in the vacuum circuit breaker, said electromagnetic operation device comprising a closing drive coil for the vacuum switch tube and a first temperature sensor that measures a temperature surrounding the closing drive coil, wherein a current caused to flow through the closing drive coil is controlled based on the temperature measured by the first temperature sensor; and further comprising an opening drive coil for the vacuum switch tube and a third temperature sensor that measures a temperature surrounding the opening drive coil, wherein a current caused to flow through the opening drive coil is controlled based on the temperature measured by the third temperature sensor.

Effect of the Invention

According to the invention, even if the temperature of the closing drive coil and/or the opening drive coil changes, it is possible to suppress change in the value of the current flowing through the closing drive coil and/or the opening drive coil. Thus, it becomes possible to provide an "electromagnetic operation device for a vacuum circuit breaker" that can fulfill the operational duty of making close/open for three cycles (50 msec) defined in the standard (JEC-2300) for vacuum circuit breakers.

MODES FOR CARRYING OUT THE INVENTION

Hereinafter, embodiments for carrying out the invention will be described based on the drawings.

Note that, in the respective figures, the same symbols represent the same or equivalent objects.

Embodiment 1

Figure 1:
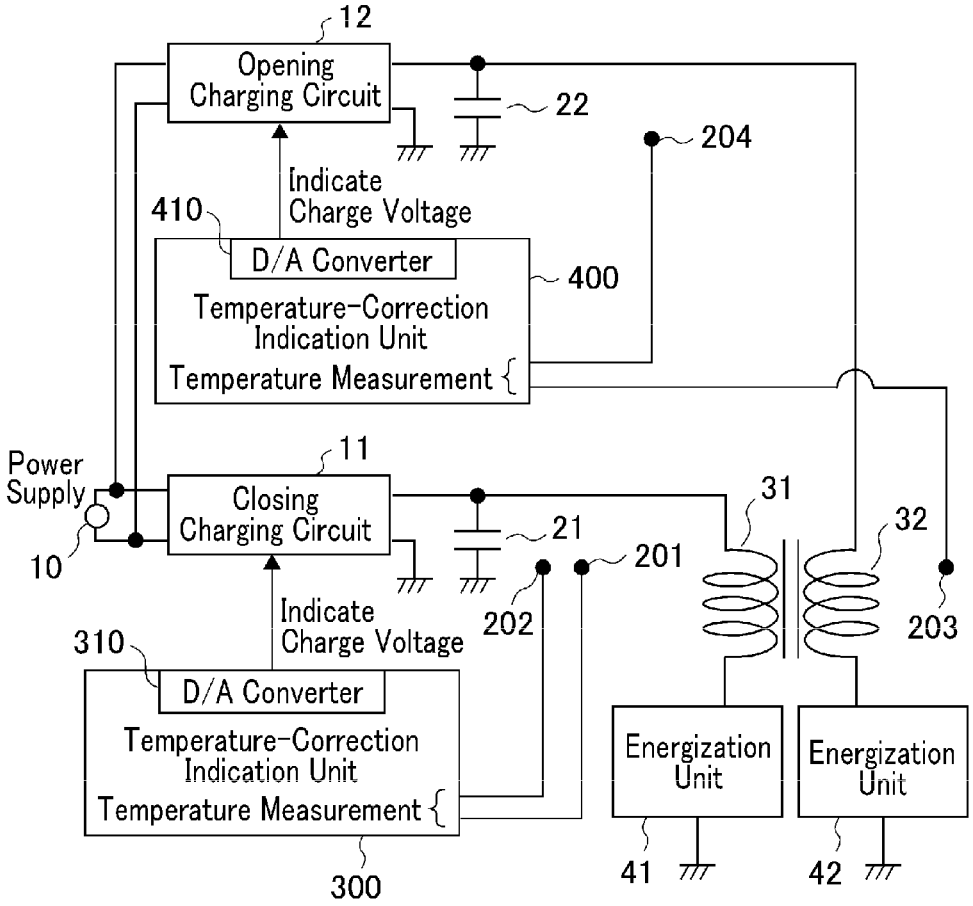
FIG. 1 is a diagram showing a configuration of an electromagnetic operation device for a vacuum circuit breaker, according to Embodiment 1.

FIG. 1 is a diagram showing a schematic configuration of an electromagnetic operation device for a vacuum circuit breaker, according to Embodiment 1.

In FIG. 1, shown at 10 is a power supply (AC power supply); at 11 is a closing charging circuit; at 12 an opening charging circuit; at 21 a closing drive capacitor; at 22 an opening drive capacitor; at 31 a closing drive coil; at 32 an opening drive coil; at 41 a first energization unit; at 42 a second energization unit; at 201 a first temperature sensor; at 202 a second temperature sensor; at 203 a third temperature sensor; at 204 a fourth temperature sensor; at 300 a first temperature-correction indication unit; and, at 400 a second temperature-correction indication unit.

Figure 6:
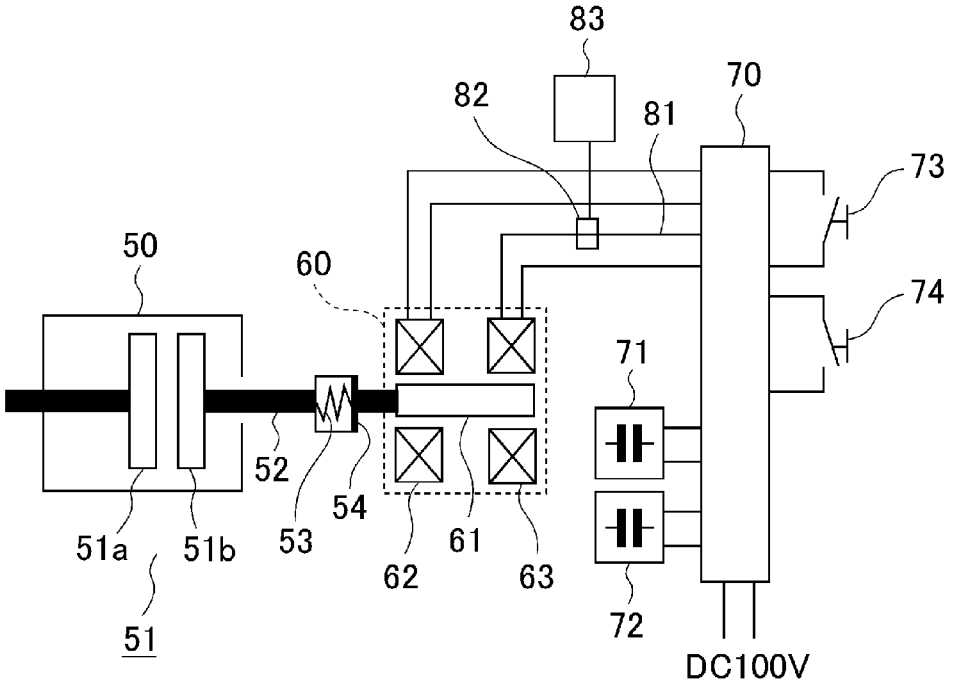
FIG. 6 is a diagram showing a configuration of an electromagnetic operation device for a vacuum circuit breaker, disclosed in Patent Document 1.
Figure 7:
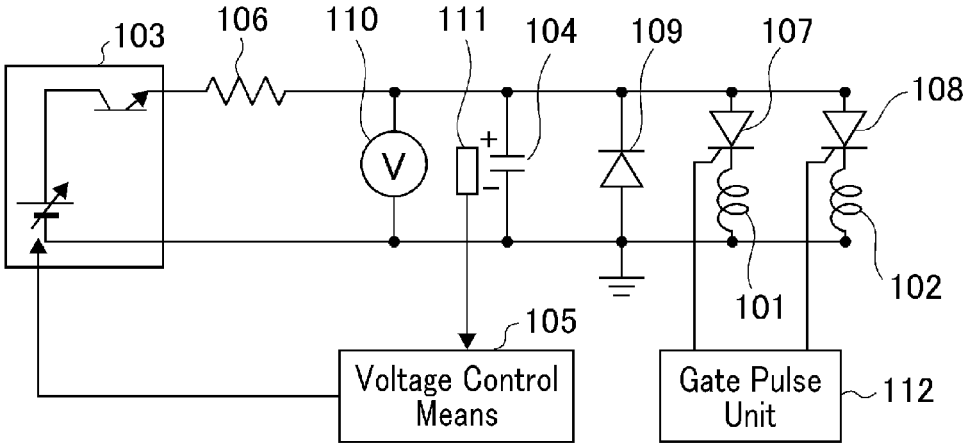
FIG. 7 is a diagram showing a configuration of an electromagnetic-repulsion drive switching device disclosed in Patent Document 2.
Figure 8:
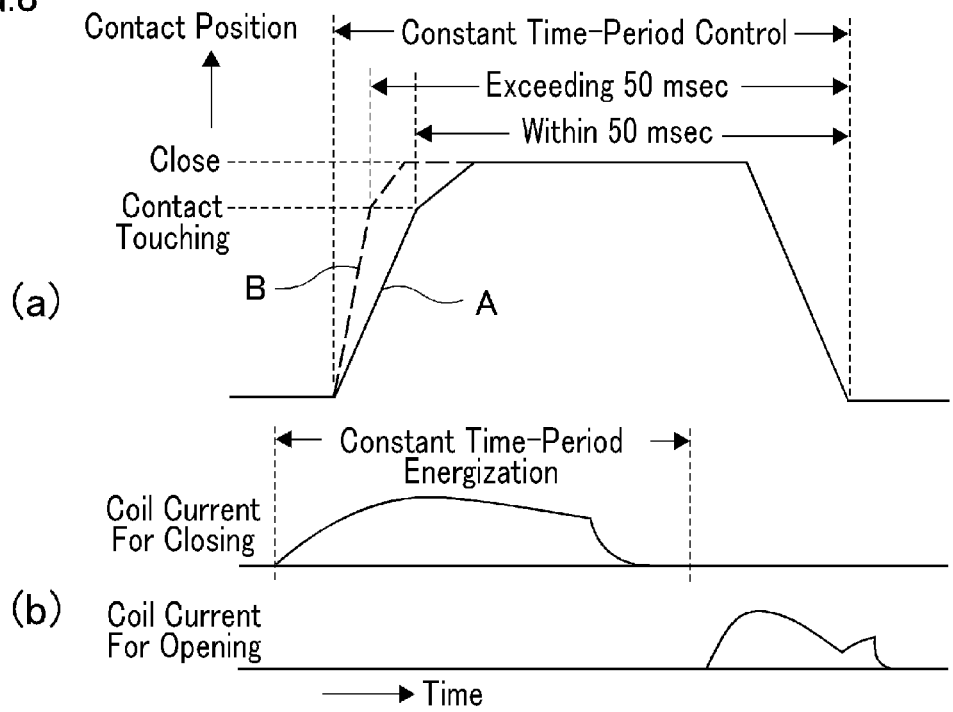
FIG. 8 is image diagrams for illustrating a problem at the time of closing operation of a conventional vacuum circuit breaker.
Figure 9:
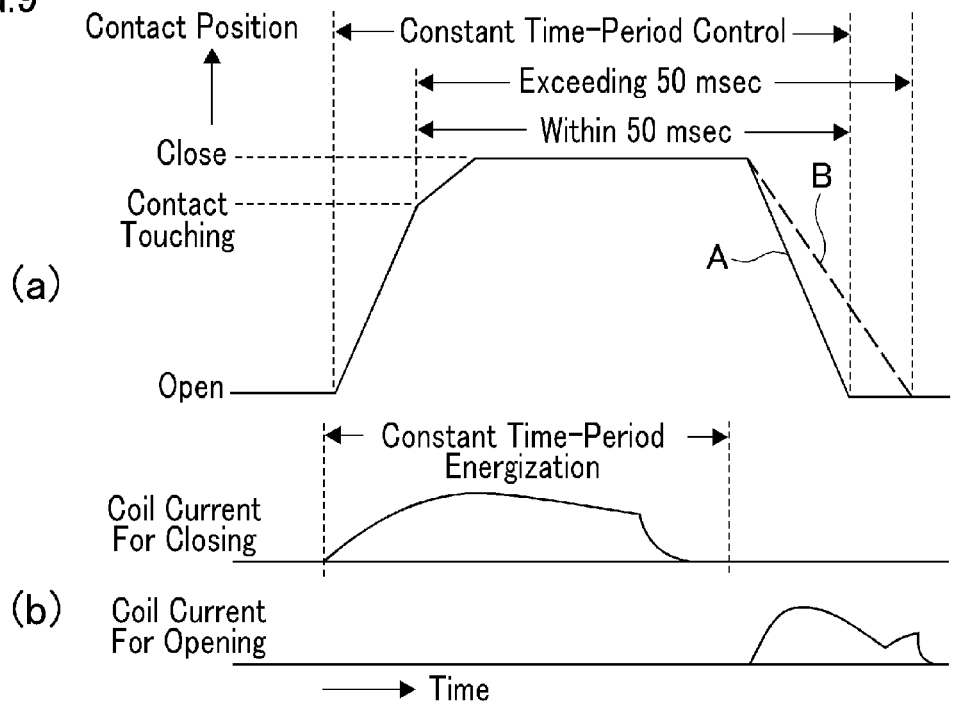
FIG. 9 is image diagrams for illustrating a problem at the time of opening operation of a conventional vacuum circuit breaker.

Note that the closing drive coil 31 corresponds to the closing drive coil 62 in FIG. 6 or the closing drive coil 101 in FIG. 7, and the opening drive coil 32 corresponds to the opening drive coil 63 in FIG. 6 or the opening drive coil 102 in FIG. 7.

First, description will be made to a case of executing a closing operation.

The closing charging circuit 11 to which a power supply voltage is applied from the power supply 10, generates a DC voltage (charge voltage) on the basis of a charge-voltage indication value indicated from the first temperature-correction indication unit 300 as described later, to thereby charge the closing drive capacitor 21. Then, the voltage charged in the closing drive capacitor 21 is applied to the closing drive coil 31, so that a current flows through the closing drive coil 31 across the first energization unit 41 which is a switch mechanism. That is, by turning on the first energization unit 41 according to a closing instruction, a current flows through the closing drive coil 31, so that the contact in a vacuum switch tube (not shown) of the vacuum circuit breaker is driven toward its closed state.

In order that the contact operation of the vacuum circuit breaker fulfills the operation specification (making close/open for three cycles) defined in the standard (JEC-2300), the time period to reach the closed state from the open state of the contact in the vacuum switch tube used in the vacuum circuit breaker (contact closing time period), has to be suppressed from changing due to change in the temperature surrounding the closing drive coil 31 (for example, from becoming too fast).

Thus, in this embodiment, the first temperature sensor 201 for measuring the temperature surrounding the closing drive coil 31 is arranged around (near) the closing drive coil 31. The temperature measured by the first temperature sensor 201 is inputted to the first temperature-correction indication unit 300.

Meanwhile, when the temperature surrounding the closing drive capacitor 21 changes, the value of the voltage to be charged in the closing drive capacitor 21 is influenced to change, and as a result, the value of the current flowing through the closing drive coil 31 changes.

That is, when the temperature surrounding the closing drive capacitor 21 changes, the value of the current flowing through the closing drive coil 31 changes too.

Thus, in this embodiment, the second temperature sensor 202 for measuring the temperature surrounding the closing drive capacitor 21 is arranged around (near) the closing drive capacitor 21. The temperature measured by the second temperature sensor 202 is inputted to the first temperature-correction indication unit 300.

Figure 2:
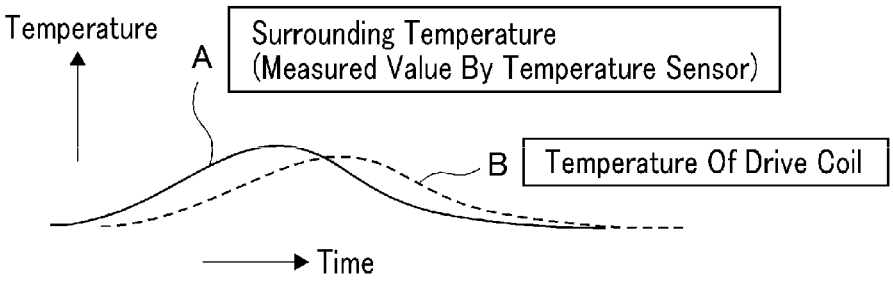
FIG. 2 is a graph showing a change in a surrounding temperature of a drive coil and a change in an actual temperature thereof.

It is noted that in this embodiment, since the first temperature sensor 201 is arranged around the closing drive coil 31, a difference emerges between the temperature measured by the first temperature sensor 201 and the actual temperature of the closing drive coil 31. That is, as shown in FIG. 2, the change in the actual temperature (indicated by the broken line B) of the drive coil (closing drive coil 31) is delayed from the change in the surrounding temperature (indicated by the solid line A) of the closing drive coil 31 measured by the first temperature sensor 201.

Further, since the second temperature sensor 202 is arranged around the closing drive capacitor 21, the change in the actual temperature of the closing drive capacitor is delayed from the change in the surrounding temperature of the closing drive capacitor 21 measured by the second temperature sensor 202, as similar to the case of delay in the measured temperature by the first temperature sensor 201.

Thus, in consideration of these delays in measured temperature, the first temperature-correction indication unit 300 determines a charge-voltage indication value for the closing charging circuit 11, on the basis of values of temperatures measured by the first temperature sensor 201 and the second temperature sensor 202 and their corresponding predetermined correction tables (or predetermined calculation formulae).

Then, the first temperature-correction indication unit 300 indicates to the closing charging circuit 11 through a D/A converter 310, a charge voltage (that is, a voltage value to be charged in the closing drive capacitor 21), so that the closing charging circuit 11 charges the closing drive capacitor 21 to the indicated voltage.

Figure 3:
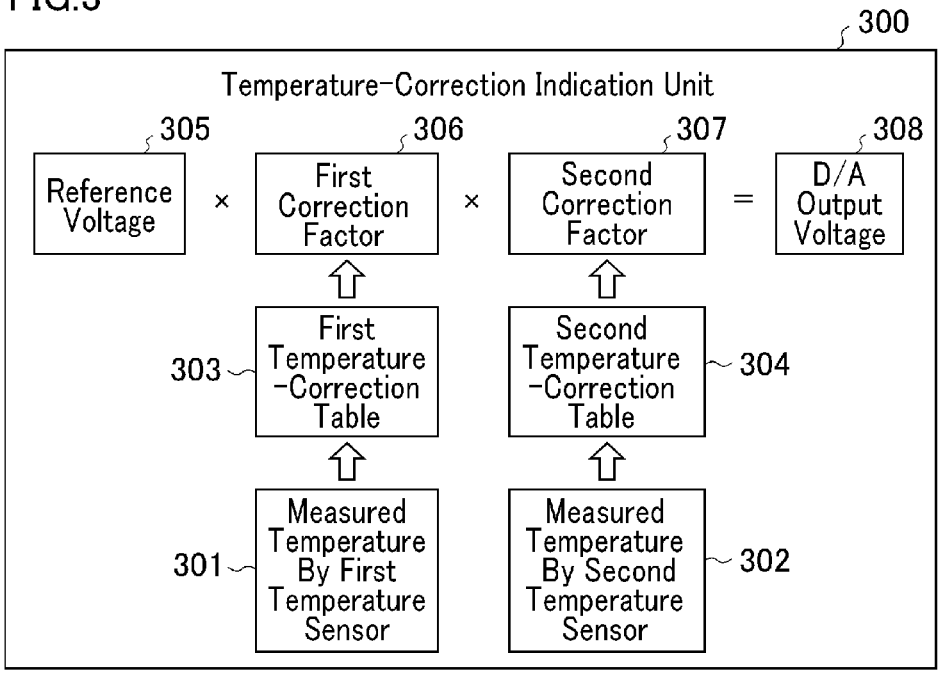
FIG. 3 is a functional illustration diagram schematically showing functions of a first temperature-correction indication unit.

FIG. 3 is a functional illustration diagram schematically showing functions of the first temperature-correction indication unit 300.

In FIG. 3, shown at 301 is a measured temperature measured by the first temperature sensor 201 arranged around the closing drive coil 31; at 302 is a measured temperature measured by the second temperature sensor 202 arranged around the closing drive capacitor 21; at 303 is a first correction table for correcting the measured temperature measured by the first temperature sensor 201; and at 304 is a second correction table for correcting the measured temperature measured by the second temperature sensor 202.

As shown in FIG. 3, in the first temperature-correction indication unit 300, the temperature measured by the first temperature sensor 201 (that is, measured temperature by the first temperature sensor 301) is corrected by the first temperature-correction table 303, and the temperature measured by the second temperature sensor 202 (that is, measured temperature by the second temperature sensor 302) is corrected by the second temperature-correction table 304.

A predetermined reference voltage (reference DC voltage at a predetermined temperature) 305, is firstly corrected by a first correction factor 306 produced from the first temperature-correction table 303. Further, the DC voltage corrected by the first correction factor 306 is corrected by a second correction factor 307 produced from the second temperature-correction table 304. Then, the DC voltage corrected by the first correction factor 306 and the second correction factor 307 is converted by the D/A converter 310 and is then outputted from the first temperature-correction indication unit 300, as the charge-voltage indication value for the closing charging circuit 11 (that is, as a D/A output voltage 308). The closing charging circuit 11 charges the closing drive capacitor 21 according to the charge-voltage indication value indicated from the first temperature-correction indication unit 300.

Next, description will be made to a case of executing an opening operation.

The opening charging circuit 12 to which a power supply voltage is applied from the power supply 10, generates a DC voltage (charge voltage) on the basis of a charge-voltage indication value indicated from the second temperature-correction indication unit 400, to thereby charge the opening drive capacitor 22. Then, the voltage charged in the opening drive capacitor 22 is applied to the opening drive coil 32, so that a current flows through the opening drive coil 32 across the second energization unit 42 which is a switch mechanism.

That is, by turning on the second energization unit 42 according to an opening instruction, a current flows through the opening drive coil 32, so that the contact in the vacuum switch tube (not shown) of the vacuum circuit breaker is driven toward its open state.

In order that the contact operation of the vacuum circuit breaker fulfills the operation specification (making close/open for three cycles) defined in the standard (JEC-2300), also in the case of opening operation, the time period to reach the open state from the closed state of the contact in the vacuum switch tube used in the vacuum circuit breaker (contact opening time period), has to be suppressed from changing due to change in the temperature surrounding the opening drive coil 32 (for example, from becoming too slow).

Thus, in this embodiment, the third temperature sensor 203 for measuring the temperature surrounding the opening drive coil 32 is arranged around (near) the opening drive coil 32. The temperature measured by the third temperature sensor 203 is inputted to the second temperature-correction indication unit 400.

Meanwhile, when the temperature surrounding the opening drive capacitor 22 changes, the value of the voltage to be charged in the opening drive capacitor 22 is influenced to change, and as a result, the value of the current flowing through the opening drive coil 32 changes.

Thus, in this embodiment, the fourth temperature sensor 204 for measuring the temperature surrounding the opening drive capacitor 22 is arranged around (near) the opening drive capacitor 22. The temperature measured by the fourth temperature sensor 204 is inputted to the second temperature-correction indication unit 400.

It is noted that in this embodiment, since the third temperature sensor 203 is arranged around the opening drive coil 32, a difference emerges between the temperature measured by the third temperature sensor 203 and the actual temperature of the opening drive coil 32. That is, as shown in FIG. 2, the change in the actual temperature (indicated by the broken line B) of the drive coil (opening drive coil 32) is delayed from the change in the surrounding temperature (indicated by the solid line A) of the opening drive coil 32 measured by the third temperature sensor 203.

Further, since the fourth temperature sensor 204 is arranged around the opening drive capacitor 22, the change in the actual temperature of the opening drive capacitor is delayed from the change in the surrounding temperature of the opening drive capacitor 22 measured by the fourth temperature sensor 204, as similar to the case of delay in the measured temperature by the third temperature sensor 203.

Thus, in consideration of these delays in measured temperature, the second temperature-correction indication unit 400 determines a charge-voltage indication value for the opening charging circuit 12, on the basis of values of temperatures measured by the third temperature sensor 203 and the fourth temperature sensor 204 and their corresponding predetermined correction tables (or predetermined calculation formulae).

Then, the second temperature-correction indication unit 400 indicates to the opening charging circuit 12 through a D/A converter 410, a charge voltage (that is, a voltage value to be charged in the opening drive capacitor 22), so that the opening charging circuit 12 charges the opening drive capacitor 22 to the indicated voltage.

Figure 4:
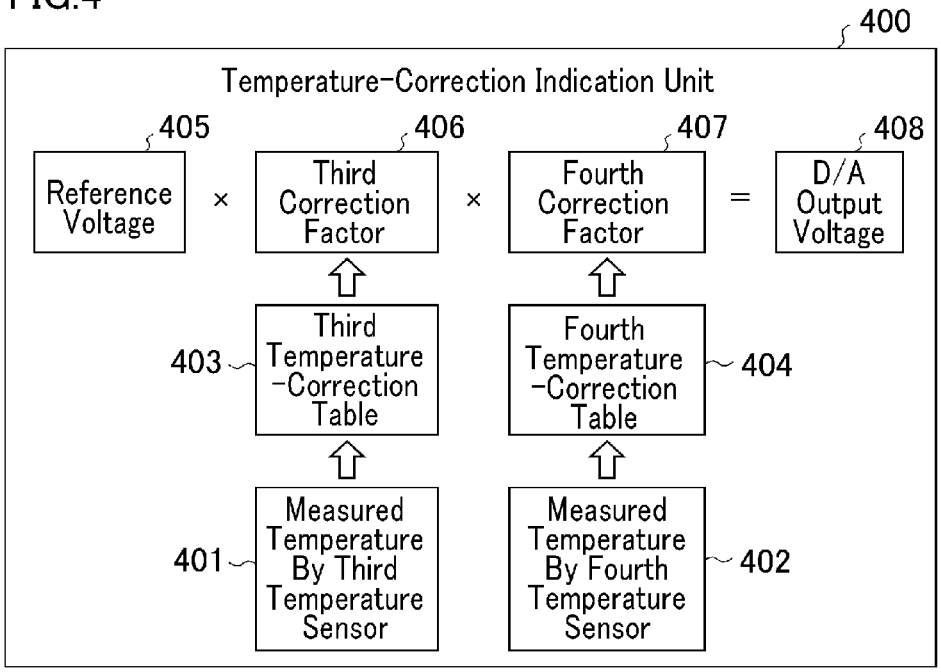
FIG. 4 is a functional illustration diagram schematically showing functions of a second temperature-correction indication unit.

FIG. 4 is a functional illustration diagram schematically showing functions of the second temperature-correction indication unit 400.

In FIG. 4, shown at 401 is a measured temperature measured by the third temperature sensor 203 arranged around the opening drive coil 32; at 402 is a measured temperature measured by the fourth temperature sensor 204 arranged around the opening drive capacitor 22; at 403 is a third correction table for correcting the measured temperature measured by the third temperature sensor 203; and at 404 is a fourth correction table for correcting the measured temperature measured by the fourth temperature sensor 204.

As shown in FIG. 4, in the second temperature-correction indication unit 400, the temperature measured by the third temperature sensor 203 (that is, measured temperature by the third temperature sensor 401) is corrected by the third temperature-correction table 403, and the temperature measured by the fourth temperature sensor 204 (that is, measured temperature by the fourth temperature sensor 402) is corrected by the fourth temperature-correction table 404.

A predetermined reference voltage (reference DC voltage at a predetermined temperature) 405, is firstly corrected by a third correction factor 406 produced from the third temperature-correction table 403. Further, the DC voltage corrected by the third correction factor 406 is corrected by a second correction factor 407 produced from the fourth temperature-correction table 404.

Then, the DC voltage corrected by the third correction factor 406 and the fourth correction factor 407 is converted by the D/A converter 410 and is then outputted from the second temperature-correction indication unit 400, as the charge-voltage indication value for the opening charging circuit 12 (that is, as a D/A output voltage 408).

The opening charging circuit 12 charges the opening drive capacitor 22 according to the charge-voltage indication value indicated from the second temperature-correction indication unit 400.

Next, description will be made to an influence by the temperature change of the closing drive capacitor or the opening drive capacitor, effected on the operation speed of the movable contact at the time of closing or opening.

When the temperature becomes lower, each capacity of the closing drive capacitor 21 and the opening drive capacitor 22 becomes smaller, so that each output voltage of the closing drive capacitor 21 and the opening drive capacitor 22 becomes lower.

This decreases the current flowing through the closing drive coil 31 or the opening drive coil 32, so that the operation speed of the movable contact at the time of closing or opening becomes slower.

With respect to the closing operation, the amount of change in the current flowing through the closing drive capacitor 31, is actually larger in the case where the contact moves faster due to decrease in the resistance value of the closing drive coil 31 when the temperature of the closing drive coil 31 becomes lower, than in the case where the contact speed becomes slower due to decrease in the capacity of the closing drive capacitor 21 when its temperature becomes lower.

Thus, a changed portion in the contact speed that is attributed to the change in the capacity of the closing drive capacitor 21, will be disappeared.

However, when the charge voltage for the closing drive capacitor 21 is corrected based solely on the temperature change of the closing drive coil 31, an error occurs due to a capacity changed portion of the closing drive capacitor 21.

The same applies to the opening operation.

In this embodiment, the charge voltage for the closing drive capacitor 21 is corrected based on both the temperature change of the closing drive coil 31 measured by the first temperature sensor 201 and the temperature change of the closing drive capacitor 21 measured by the second temperature sensor 202.

Likewise, the charge voltage for the opening drive capacitor 22 is corrected based on both the temperature change of the opening drive coil 32 measured by the third temperature sensor 203 and the temperature change of the opening drive capacitor 22 measured by the fourth temperature sensor 204.

By doing so, it is possible to stably and accurately control the current flowing through the closing drive coil 31, even if the surrounding temperature of the closing drive coil 31 or the closing drive capacitor 21 changes. Likewise, it is possible to stably and accurately control the current flowing through the opening drive coil 32, even if the surrounding temperature of the opening drive coil 32 or the opening drive capacitor 22 changes.

Accordingly, the closing operation speed and the opening operation speed of the switching contact can be accurately fallen within a predetermined range.

That is, it becomes possible to stably and accurately control the closing operation and/or the opening operation of the contact so that the vacuum circuit breaker fulfills the operational duty (that is, making close/open for three cycles).

It is noted here that in the above description, such cases are described, where the first temperature sensor 201 for measuring the surrounding temperature of the closing drive coil 31 is arranged around the closing drive coil 31, and the second temperature sensor 202 for measuring the surrounding temperature of the closing drive capacitor 21 is arranged around the closing drive capacitor 21, so that the charge voltage for the closing drive capacitor 21 is corrected based on the temperatures measured by both of the sensors; and where the third temperature sensor 203 for measuring the surrounding temperature of the opening drive coil 32 is arranged around the opening drive coil 32, and the fourth temperature sensor 204 for measuring the surrounding temperature of the opening drive capacitor 22 is arranged around the opening drive capacitor 22, so that the charge voltage for the opening drive capacitor 22 is corrected based on the temperatures measured by both of the sensors.

However, it is allowable not to arrange the second temperature sensor 202 for measuring the surrounding temperature of the closing drive capacitor 21 around the closing drive capacitor 21, and thus to provide a configuration in which the first temperature sensor 201 for measuring the surrounding temperature of the closing drive coil 31 is solely arranged around the closing drive coil 31. Also, it is allowable not to arrange the fourth temperature sensor 204 for measuring the surrounding temperature of the opening drive capacitor 22 around the opening drive capacitor 22, and thus to provide a configuration in which the third temperature sensor 203 for measuring the surrounding temperature of the opening drive coil 32 is solely arranged around the opening drive coil 32.

In this instance, although an accuracy for correcting the charge voltage for the closing drive capacitor 21 or the opening drive capacitor 22 is somewhat degraded, it is possible to control the current flowing through the closing drive coil 31 or the opening drive coil 32 to have an almost constant value.

That is, the contact switching speed can be suppressed to be almost constant even without arranging the second temperature sensor 202 or the fourth temperature sensor 204, so that the operational duty of making close/open for three cycles defined in the standard (JEC-2300) can be fulfilled.

It is noted that, in vacuum circuit breakers, when the contact switching speed of the vacuum switch tube becomes faster, the impact at the time of contact switching becomes greater, thus shortening the life duration of the vacuum switch tube, whereas when the contact switching speed becomes slower, the closing operation of the vacuum circuit breaker becomes unstable, thus causing a state incapable of keeping a power-throw.

According to this embodiment, however, it is possible to cause switching of the contact of the vacuum circuit breaker at an optimum speed (that is, a least one of the speed required to fulfill the operational duty) regardless of change in the temperature of the closing drive coil 31, the opening drive coil 32, the closing drive capacitor 21 or the opening drive capacitor 22. Thus, it becomes possible to reduce too-much impact at the time of contact switching, to thereby prolong the life duration of the vacuum switch tube in the vacuum circuit breaker.

By the way, in the above description, such a case is described, where the first temperature sensor 201 for measuring the surrounding temperature of the closing drive coil 31 is arranged around the closing drive coil 31, and the second temperature sensor 202 for measuring the surrounding temperature of the closing drive capacitor 21 is arranged around the closing drive capacitor 21, so that the charge voltage for the closing drive capacitor 21 is corrected based on the temperatures measured by both of the sensors.

Further described is such a case where the third temperature sensor 203 for measuring the surrounding temperature of the opening drive coil 32 is arranged around the opening drive coil 32, and the fourth temperature sensor 204 for measuring the surrounding temperature of the opening drive capacitor 22 is arranged around the opening drive capacitor 22, so that the charge voltage for the closing drive capacitor 21 is corrected based on the temperatures measured by both of the sensors.

As described above, an electromagnetic operation device for a vacuum circuit breaker according to this embodiment, is such an electromagnetic operation device for a vacuum circuit breaker which controls by its electromagnetic operation, a speed of contact switching operation of a vacuum switch tube used in the vacuum circuit breaker, said electromagnetic operation device including the closing drive coil 31 for the vacuum switch tube, and the first temperature sensor 201 that measures the temperature surrounding the closing drive coil 31, wherein a current caused to flow through the closing drive coil 31 is controlled based on the temperature measured by the first temperature sensor 201.

Thus, the current flowing through the closing drive coil 31 can be controlled even if the surrounding temperature of the closing drive coil 31 changes; therefore, it is possible to control the closing operation speed of the switching contact to fall within a predetermined range, and thus to move the contact so that the vacuum circuit breaker fulfills the operational duty (that is, making close/open for three cycles).

Further, an electromagnetic operation device for a vacuum circuit breaker according to this embodiment, is such an electromagnetic operation device for a vacuum circuit breaker which controls by its electromagnetic operation, a speed of contact switching operation of a vacuum switch tube used in the vacuum circuit breaker, said electromagnetic operation device including the opening drive coil 32 for the vacuum switch tube, and the third temperature sensor 203 that measures the temperature surrounding the opening drive coil 32, wherein a current caused to flow through the opening drive coil 32 is controlled based on the temperature measured by the third temperature sensor 203.

Thus, the current flowing through the opening drive coil 32 can be controlled even if the surrounding temperature of the opening drive coil 32 changes; therefore, it is possible to control the opening operation speed of the switching contact to fall within a predetermined range, and thus to move the contact so that the vacuum circuit breaker fulfills the operational duty.

Further, an electromagnetic operation device for a vacuum circuit breaker according to this embodiment, is such an electromagnetic operation device for a vacuum circuit breaker which controls by its electromagnetic operation, a speed of contact switching operation of a vacuum switch tube used in the vacuum circuit breaker, said electromagnetic operation device including the closing drive coil 31 for the vacuum switch tube, and the first temperature sensor 201 that measures the temperature surrounding the closing drive coil 31, wherein a current caused to flow through the closing drive coil 31 is controlled based on the temperature measured by the first temperature sensor 201; and said electromagnetic operation device further including the opening drive coil 32 for the vacuum switch tube, and the third temperature sensor 203 that measures the temperature surrounding the opening drive coil 32, wherein a current caused to flow through the opening drive coil 32 is controlled based on the temperature measured by the third temperature sensor 203.

Thus, the currents flowing through the closing drive coil 31 and the opening drive coil 32 can be controlled even if the surrounding temperature of the closing drive coil 31 or the opening drive coil 32 changes; therefore, it is possible to control the closing operation speed and the opening operation speed of the switching contact to fall within predetermined ranges, and thus to move the contact so that the vacuum circuit breaker surely fulfills the operational duty.

Further, an electromagnetic operation device for a vacuum circuit breaker according to this embodiment, is such an electromagnetic operation device for a vacuum circuit breaker which controls by its electromagnetic operation, a speed of contact switching operation of a vacuum switch tube used in the vacuum circuit breaker, said electromagnetic operation device including the closing drive coil 31 for the vacuum switch tube, the closing drive capacitor 21 for causing a contact-closing drive current to flow through the closing drive coil 31, the closing charging circuit 11 that charges the closing drive capacitor 21, the first temperature sensor 201 that measures the temperature surrounding the closing drive coil 31, and the first temperature-correction indication unit 300 that indicates to the closing charging circuit 11, a charge voltage correction value for the closing drive capacitor 21, on the basis of the temperature measured by the first temperature sensor 201.

Since the first temperature-correction indication unit 300 indicates to the closing charging circuit 11, a charge voltage correction value for the closing drive capacitor 21, on the basis of the temperature measured by the first temperature sensor 201, it is possible to accurately control the current flowing through the closing drive coil 31 even if the surrounding temperature of the closing drive coil 31 changes.

Further, in an electromagnetic operation device for a vacuum circuit breaker according to this embodiment, the second temperature sensor 202 is provided that measures the temperature surrounding the closing drive capacitor 21, and the first temperature-correction indication unit 300 indicates to the closing charging circuit 11, the charge voltage correction value for the closing drive capacitor 21, on the basis of the temperatures measured by the first temperature sensor 201 and the second temperature sensor 202.

Thus, it is possible to accurately control the current flowing through the closing drive coil 31 even if the surrounding temperatures of both of the closing drive coil 31 and the closing drive capacitor 21 change.

Further, an electromagnetic operation device for a vacuum circuit breaker according to this embodiment, is such an electromagnetic operation device for a vacuum circuit breaker which controls by its electromagnetic operation, a speed of contact switching operation of a vacuum switch tube used in the vacuum circuit breaker, said electromagnetic operation device including the opening drive coil 32 for the vacuum switch tube, the opening drive capacitor 22 for causing a contact-opening drive current to flow through the opening drive coil 32, the opening charging circuit 12 that charges the opening drive capacitor 22, the third temperature sensor 203 that measures the temperature surrounding the opening drive coil 32, and the second temperature-correction indication unit 400 that indicates to the opening charging circuit 12, a charge voltage correction value for the opening drive capacitor 22, on the basis of the temperature measured by the third temperature sensor 203.

Since the second temperature-correction indication unit 400 indicates to the opening charging circuit 12, a charge voltage correction value for the opening drive capacitor 22, on the basis of the temperature measured by the third temperature sensor 203, it is possible to accurately control the current flowing through the opening drive coil 32 even if the surrounding temperature of the opening drive coil 32 changes.

Further, in an electromagnetic operation device for a vacuum circuit breaker according to this embodiment, the fourth temperature sensor 204 is provided that measures the temperature surrounding the opening drive capacitor 22, and the second temperature-correction indication unit 400 indicates to the opening charging circuit 12, the charge voltage correction value for the opening drive capacitor 22, on the basis of the temperatures measured by the third temperature sensor 203 and the fourth temperature sensor 204.

Thus, it is possible to accurately control the current flowing through the closing drive coil 31 even if the surrounding temperatures of both of the opening drive coil 32 and the opening drive capacitor 22 change.

Further, an electromagnetic operation device for a vacuum circuit breaker according to this embodiment, is such an electromagnetic operation device for a vacuum circuit breaker which controls by its electromagnetic operation, a speed of contact switching operation of a vacuum switch tube used in the vacuum circuit breaker, said electromagnetic operation device including the closing drive coil 31 for the vacuum switch tube, the closing drive capacitor 21 for causing a contact-closing drive current to flow through the closing drive coil 31, the closing charging circuit 11 that charges the closing drive capacitor 21, the first temperature sensor 201 that measures a temperature surrounding the closing drive coil 31, the second temperature sensor 202 that measures a temperature surrounding the closing drive capacitor 21, and the first temperature-correction indication unit 300 that indicates to the closing charging circuit 11, a charge voltage correction value for the closing drive capacitor 21, on the basis of the temperatures measured by the first temperature sensor 201 and the second temperature sensor 202, and said electromagnetic operation device further including the opening drive coil 32 for the vacuum switch tube, the opening drive capacitor 22 for causing a contact-opening drive current to flow through the opening drive coil 32, the opening charging circuit 12 that charges the opening drive capacitor 22, the third temperature sensor 203 that measures a temperature surrounding the opening drive coil 32, the fourth temperature sensor 204 that measures a temperature surrounding the opening drive capacitor 22, and the second temperature-correction indication unit 400 that indicates to the opening charging circuit 12, a charge voltage correction value for the opening drive capacitor 22, on the basis of the temperatures measured by the third temperature sensor 203 and the fourth temperature sensor 204.

Thus, it is possible to accurately control the current flowing through the closing drive coil 31 and the opening drive coil 32 even if the surrounding temperatures of the closing drive coil 31 and the closing drive capacitor 21 or the surrounding temperatures of the opening drive coil 32 and the opening drive capacitor 22 change.

Embodiment 2

In the foregoing Embodiment 1, description is made to the case where the first temperature sensor 201 for measuring the surrounding temperature of the closing drive coil 31 is arranged around the closing drive coil 31, or the case where the third temperature sensor 203 for measuring the surrounding temperature of the opening drive coil 32 is arranged around the opening drive coil 32, whereas, an electromagnetic operation device according to Embodiment 2 is characterized in that the first temperature sensor 201 is embedded in the closing drive coil 31 and the third temperature sensor 203 is embedded in the opening drive coil 32.

This makes it possible to directly measure the temperature of the closing drive coil 31 or the opening drive coil 32, and thus to enhance accuracy for correcting the charge voltage for the closing drive capacitor 21 or the opening drive capacitor 22 with respect to a change in the surrounding temperature.

That is, according to this embodiment, since the current flowing through the closing drive coil 31 or the opening drive coil 32 can be more accurately controlled, it becomes possible to suppress the closing operation speed of the switching contact to be within a predetermined range.

Embodiment 3

Figure 5:
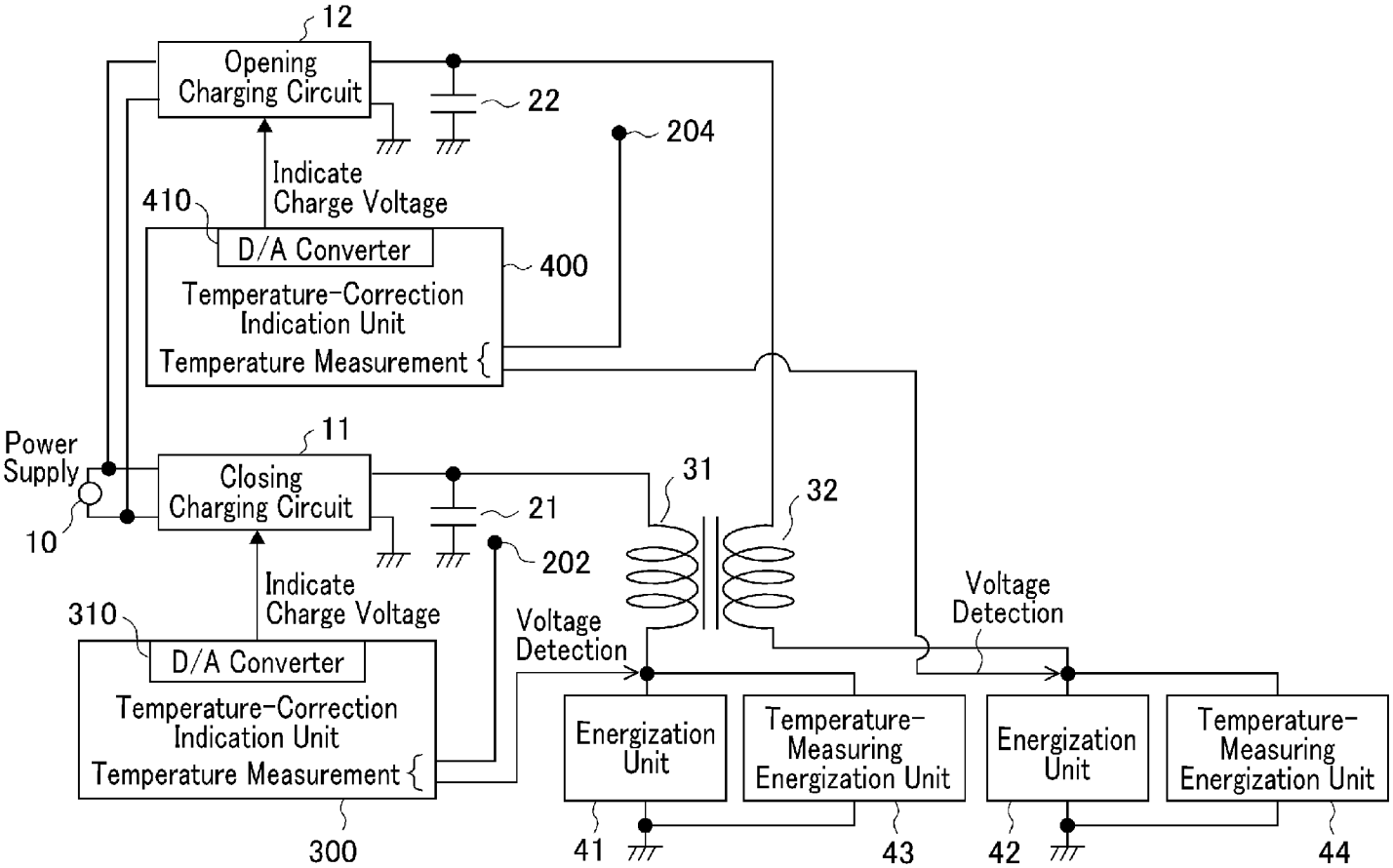
FIG. 5 is a diagram showing a configuration of an electromagnetic operation device for a vacuum circuit breaker, according to Embodiment 3.

FIG. 5 is a diagram showing a configuration of an electromagnetic operation device for a vacuum circuit breaker, according to Embodiment 3.

In the foregoing Embodiment 1, the temperature of the closing drive coil 31 is measured by using the first temperature sensor 201 arranged around the closing drive coil 31 and the temperature of the opening drive coil 32 is measured by using the third temperature sensor 203 arranged around the opening drive coil 32, whereas this embodiment is characterized in that, as shown in FIG. 5, a first temperature-measuring energization unit 43 is provided instead of using the first temperature sensor 201, and a second temperature-measuring energization unit 44 is provided instead of the third temperature sensor 203.

In this embodiment, a weak current is caused to flow through the closing drive coil 31 by the first temperature-measuring energization unit 43.

Then, the first temperature-correction indication unit 300 determines the resistance value of the closing drive coil 31 by detecting a value of the voltage produced due to the weak current flowing through the closing drive coil 31.

Because the resistance value of the closing drive coil 31 changes depending on its temperature, the first temperature-correction indication unit 300 determines the temperature of the closing drive coil 31 through calculation after determined the resistance value of the closing drive coil 31.

The first temperature-correction indication unit 300 corrects the charge voltage for the closing drive capacitor 21 on the basis of both of the temperature of the closing drive coil 31 determined through calculation and the temperature of the closing drive capacitor 21 measured by the second temperature sensor 202.

Likewise, in this embodiment, a weak current is caused to flow through the opening drive coil 32 by the second temperature-measuring energization unit 44.

Then, the second temperature-correction indication unit 400 determines the resistance value of the opening drive coil 32 by detecting a value of the voltage produced due to the weak current flowing through the opening drive coil 32.

Because the resistance value of the opening drive coil 32 changes depending on its temperature, the second temperature-correction indication unit 400 determines the temperature of the opening drive coil 32 through calculation after determined the resistance value of the opening drive coil 32.

The second temperature-correction indication unit 400 corrects the charge voltage for the opening drive capacitor 22 on the basis of both of the temperature of the opening drive coil 32 determined through calculation and the temperature of the opening drive capacitor 22 measured by the fourth temperature sensor 204.

As described above, an electromagnetic operation device according to this embodiment includes, instead of the first temperature sensor 201 in Embodiment 1, the first temperature-measuring energization unit 43 for causing a current to flow through the closing drive coil 31; wherein the first temperature-correction indication unit 300 includes a closing-drive-coil temperature measuring means that determines the resistance value of the closing drive coil 31 by detecting a value of the voltage produced due to the current flowing through the closing drive coil 31 caused by the first temperature-measuring energization unit 43, followed by measuring the temperature of the closing drive coil 31 through calculation from the determined resistance value; and wherein the first temperature-correction indication unit 300 indicates to the closing charging circuit 11, the charge voltage correction value for the closing drive capacitor 21, on the basis of the temperatures measured by the closing-drive-coil temperature measuring means and the second temperature sensor 202.

Thus, according to this embodiment, it becomes possible to determine the temperature of the closing drive coil 31 without using the first temperature sensor 201 for measuring the temperature of the closing drive coil 31.

Further, an electromagnetic operation device according to this embodiment includes, instead of the third temperature sensor 203 in Embodiment 1, the second temperature-measuring energization unit 44 for causing a current to flow through the opening drive coil 32; wherein the second temperature-correction indication unit 400 includes an opening-drive-coil temperature measuring means that determines the resistance value of the opening drive coil 32 by detecting a value of the voltage produced due to the current flowing through the opening drive coil caused by the second temperature-measuring energization unit 44, followed by measuring the temperature of the opening drive coil 32 through calculation from the determined resistance value; and wherein the second temperature-correction indication unit 400 indicates to the opening charging circuit 12, the charge voltage correction value for the opening drive capacitor 12, on the basis of the temperatures measured by the opening-drive-coil temperature measuring means and the fourth temperature sensor 204.

Thus, according to this embodiment, it becomes possible to determine the temperature of the opening drive coil 32 without using the third temperature sensor 203 for measuring the temperature of the opening drive coil 32.

Further, an electromagnetic operation device according to this embodiment includes, instead of the first temperature sensor 201, the first temperature-measuring energization unit 43 for causing a current to flow through the closing drive coil 31, wherein the first temperature-correction indication unit 300 indicates to the closing charging circuit 11, the charge voltage correction value for the closing drive capacitor 21, on the basis of the temperatures measured by the closing-drive-coil temperature measuring means and the second temperature sensor 202, said electromagnetic operation device further including, instead of the third temperature sensor 203, the second temperature-measuring energization unit 44 for causing a current to flow through the opening drive coil 32, wherein the second temperature-correction indication unit 400 indicates to the opening charging circuit 12, the charge voltage correction value for the opening drive capacitor 22, on the basis of the temperatures measured by the opening-drive-coil temperature measuring means and the fourth temperature sensor 204.

Thus, according to this embodiment, it becomes possible to determine the temperature of the closing drive coil 31 without using the first temperature sensor 201 for measuring the temperature of the closing drive coil 31, and also to determine the temperature of the opening drive coil 32 without using the third temperature sensor 203 for measuring the temperature of the opening drive coil 32.

INDUSTRIAL APPLICABILITY

This invention is useful for actualizing an electromagnetic operation device for a vacuum circuit breaker which can suppress a change in closing operation speed or opening operation speed even if the temperature surrounding the drive coil or the drive capacitor changes, thereby making it possible to fulfill the operational duty of making close/open for three cycles (50 msec) defined in the standard (JEC-2300).

DESCRIPTION OF REFERENCE NUMERALS AND SIGNS

10: power supply, 11: closing charging circuit, 12: opening charging circuit, 21: closing drive capacitor, 22: opening drive capacitor, 31: closing drive coil, 32: opening drive coil, 41: first energization unit, 42: second energization unit, 43: first temperature-measuring energization unit, 44: second temperature-measuring energization unit, 201: first temperature sensor, 202: second temperature sensor, 203: third temperature sensor, 204: fourth temperature sensor, 300: first temperature-correction indication unit, 400: second temperature-correction indication unit.

The invention claimed is:

1. An electromagnetic operation device for a vacuum circuit breaker, which controls by its electromagnetic operation, a speed of contact switching operation of a vacuum switch tube used in the vacuum circuit breaker, the electromagnetic operation device comprising:

a closing drive coil for the vacuum switch tube; and a first temperature sensor that measures a temperature surrounding the closing drive coil;

wherein a current caused to flow through the closing drive coil is controlled based on the temperature measured by the first temperature sensor.

2. The electromagnetic operation device for a vacuum circuit breaker of claim 1, wherein the first temperature sensor is embedded in the closing drive coil.

3. An electromagnetic operation device for a vacuum circuit breaker, which controls by its electromagnetic operation, a speed of contact switching operation of a vacuum switch tube used in the vacuum circuit breaker, the electromagnetic operation device comprising:

an opening drive coil for the vacuum switch tube; and a third temperature sensor that measures a temperature surrounding the opening drive coil;

wherein a current caused to flow through the opening drive coil is controlled based on the temperature measured by the third temperature sensor.

4. The electromagnetic operation device for a vacuum circuit breaker of claim 3, wherein the third temperature sensor is embedded in the opening drive coil.

5. An electromagnetic operation device for a vacuum circuit breaker, which controls by its electromagnetic operation, a speed of contact switching operation of a vacuum switch tube used in the vacuum circuit breaker, the electromagnetic operation device comprising:

a closing drive coil for the vacuum switch tube;

a first temperature sensor that measures a temperature surrounding the closing drive coil;

wherein a current caused to flow through the closing drive coil is controlled based on the temperature measured by the first temperature sensor, an opening drive coil for the vacuum switch tube; and a third temperature sensor that measures a temperature surrounding the opening drive coil;

wherein a current caused to flow through the opening drive coil is controlled based on the temperature measured by the third temperature sensor.

6. The electromagnetic operation device for a vacuum circuit breaker of claim 5, wherein the first temperature sensor is embedded in the closing drive coil.

7. The electromagnetic operation device for a vacuum circuit breaker of claim 5, wherein the third temperature sensor is embedded in the opening drive coil.

8. An electromagnetic operation device for a vacuum circuit breaker, which controls by its electromagnetic operation, a speed of contact switching operation of a vacuum switch tube used in the vacuum circuit breaker, the electromagnetic operation device comprising:

a closing drive coil for the vacuum switch tube;

a closing drive capacitor for causing a contact-closing drive current to flow through the closing drive coil;

a closing charging circuit that charges the closing drive capacitor;

a first temperature sensor that measures a temperature surrounding the closing drive coil; and a first temperature-correction indication unit that indicates to the closing charging circuit, a charge voltage correction value for the closing drive capacitor, on the basis of the temperature measured by the first temperature sensor.

9. The electromagnetic operation device for a vacuum circuit breaker of claim 8, wherein:

a second temperature sensor is provided that measures a temperature surrounding the closing drive capacitor; and the first temperature-correction indication unit indicates to the closing charging circuit, the charge voltage correction value for the closing drive capacitor, on the basis of the temperatures measured by the first temperature sensor and the second temperature sensor.

10. The electromagnetic operation device for a vacuum circuit breaker of claim 9, which comprises, instead of the first temperature sensor, a first temperature-measuring energization unit for causing a current to flow through the closing drive coil; wherein, the first temperature-correction indication unit indicates to the closing charging circuit, the charge voltage correction value for the closing drive capacitor, on the basis of the temperatures measured by the closing-drive-coil temperature measuring means and the second temperature sensor; and which further comprises, instead of the third temperature sensor, a second temperature-measuring energization unit for causing a current to flow through the opening drive coil; wherein, the second temperature-correction indication unit indicates to the opening charging circuit, the charge voltage correction value for the opening drive capacitor, on the basis of the temperatures measured by the opening-drive-coil temperature measuring means and the fourth temperature sensor.

11. The electromagnetic operation device for a vacuum circuit breaker of claim 9, which comprises, instead of the first temperature sensor, a first temperature-measuring energization unit for causing a current to flow through the closing drive coil, wherein, the first temperature-correction indication unit includes a closing-drive-coil temperature measuring means that determines a resistance value of the closing drive coil by detecting a value of voltage produced due to the current flowing through the closing drive coil caused by the first temperature-measuring energization unit, followed by measuring a temperature of the closing drive coil through calculation from the determined resistance value, and the first temperature-correction indication unit indicates to the closing charging circuit, the charge voltage correction value for the closing drive capacitor, on the basis of the temperatures measured by the closing-drive-coil temperature measuring means and the second temperature sensor.

12. The electromagnetic operation device for a vacuum circuit breaker of claim 8, wherein the first temperature sensor is embedded in the closing drive coil.

13. An electromagnetic operation device for a vacuum circuit breaker, which controls by its electromagnetic operation, a speed of contact switching operation of a vacuum switch tube used in the vacuum circuit breaker, the electromagnetic operation device comprising:

an opening drive coil for the vacuum switch tube;

an opening drive capacitor for causing a contact-opening drive current to flow through the opening drive coil;

an opening charging circuit that charges the opening drive capacitor;

a third temperature sensor that measures a temperature surrounding the opening drive coil; and a second temperature-correction indication unit that indicates to the opening charging circuit, a charge voltage correction value for the opening drive capacitor, on the basis of the temperature measured by the third temperature sensor.

14. The electromagnetic operation device for a vacuum circuit breaker of claim 13, wherein:

a fourth temperature sensor is provided that measures a temperature surrounding the opening drive capacitor; and the second temperature-correction indication unit indicates to the opening charging circuit, the charge voltage correction value for the opening drive capacitor, on the basis of the temperatures measured by the third temperature sensor and the fourth temperature sensor.

15. The electromagnetic operation device for a vacuum circuit breaker of claim 14, which comprises, instead of the third temperature sensor, a second temperature-measuring energization unit for causing a current to flow through the opening drive coil; wherein, the second temperature-correction indication unit includes an opening-drive-coil temperature measuring means that determines a resistance value of the opening drive coil by detecting a value of voltage produced due to the current flowing through the opening drive coil caused by the second temperature-measuring energization unit, followed by measuring a temperature of the opening drive coil through calculation from the determined resistance value; and the second temperature-correction indication unit indicates to the opening charging circuit, the charge voltage correction value for the opening drive capacitor, on the basis of the temperatures measured by the opening-drive-coil temperature measuring means and the fourth temperature sensor.

16. The electromagnetic operation device for a vacuum circuit breaker of claim 14, which comprises, instead of the first temperature sensor, a first temperature-measuring energization unit for causing a current to flow through the closing drive coil; wherein, the first temperature-correction indication unit indicates to the closing charging circuit, the charge voltage correction value for the closing drive capacitor, on the basis of the temperatures measured by the closing-drive-coil temperature measuring means and the second temperature sensor; and which further comprises, instead of the third temperature sensor, a second temperature-measuring energization unit for causing a current to flow through the opening drive coil; wherein, the second temperature-correction indication unit indicates to the opening charging circuit, the charge voltage correction value for the opening drive capacitor, on the basis of the temperatures measured by the opening-drive-coil temperature measuring means and the fourth temperature sensor.

17. The electromagnetic operation device for a vacuum circuit breaker of claim 13, wherein the third temperature sensor is embedded in the opening drive coil.

18. An electromagnetic operation device for a vacuum circuit breaker, which controls by its electromagnetic operation, a speed of contact switching operation of a vacuum switch tube used in the vacuum circuit breaker, the electromagnetic operation device comprising:

a closing drive coil for the vacuum switch tube;

a closing drive capacitor for causing a contact-closing drive current to flow through the closing drive coil;

a closing charging circuit that charges the closing drive capacitor;

a first temperature sensor that measures a temperature surrounding the closing drive coil;

a second temperature sensor that measures a temperature surrounding the closing drive capacitor;

a first temperature-correction indication unit that indicates to the closing charging circuit, a charge voltage correction value for the closing drive capacitor, on the basis of the temperatures measured by the first temperature sensor and the second temperature sensor;

an opening drive coil for the vacuum switch tube;

an opening drive capacitor for causing a contact-opening drive current to flow through the opening drive coil;

an opening charging circuit that charges the opening drive capacitor;

a third temperature sensor that measures a temperature surrounding the opening drive coil; and a fourth temperature sensor that measures a temperature surrounding the opening drive capacitor; and a second temperature-correction indication unit that indicates to the opening charging circuit, a charge voltage correction value for the opening drive capacitor, on the basis of the temperatures measured by the third temperature sensor and the fourth temperature sensor.

* * * * *